US005624018A

United States Patent [19]

Schuff et al.

[11] Patent Number: 5,624,018

[45] Date of Patent: Apr. 29, 1997

[54] ALUMINUM CAN RECYCLING AND COUPON DISPENSER APPARATUS

[76] Inventors: David A. Schuff, 4302 W. Acoma; Roy C. Burnett, 4635 W. Dailey, both of Glendale, Ariz. 85306; Joseph R. Goetz, 550 E. Encinas Ave., Gilbert, Ariz. 85234

[21] Appl. No.: 563,612

[22] Filed: Nov. 28, 1995

[51] Int. Cl.[6] ..... G07F 7/06

[52] U.S. Cl. ..... 194/209; 100/902; 194/213

[58] Field of Search ..... 194/208, 209, 194/212, 213; 100/902

[56] References Cited

U.S. PATENT DOCUMENTS

| | | | |
|---|---|---|---|
| Re. 27,643 | 5/1973 | Myers | 194/208 |
| 4,241,821 | 12/1980 | Wu et al. | 100/902 X |
| 4,248,334 | 2/1981 | Hanley et al. | 194/209 |
| 4,989,507 | 2/1991 | Rhoades et al. | 100/902 X |
| 5,239,920 | 8/1993 | Schuff et al. | 194/208 X |

*Primary Examiner*—F. J. Bartuska
*Attorney, Agent, or Firm*—H. Gordon Shields

[57] ABSTRACT

Aluminum can recycling and coupon dispenser apparatus includes a housing having a front door and a can receiving slot on the front of the door. Cans fall onto a conveyor belt which transmits or transports the cans to a conduit through which aluminum cans fall to a crusher. Ferrous cans remain on the conveyor held by magnetic elements and are pushed off the conveyor and are discarded. After being crushed for recycling, the cans are transported upwardly by a moving air stream to the upper portion of the housing and the cans fall rearwardly and downwardly to a storage bin where they remain until the bin is transported out of the apparatus. The storage bin may be removed intact and replaced by another storage bin. All of the active elements are secured to the door. The door is pivoted to remove the storage bin containing the crushed cans. Information is displayed while the can crushing is being accomplished and coupons are dispensed in response to user input on a keypad. The user input is in turn responsive to the displayed information.

26 Claims, 4 Drawing Sheets

ALUMINUM CAN RECYCLING AND COUPON DISPENSER APPARATUS

BACKGROUND OF THE INVENTION

1. Field of Invention

This invention relates to aluminum can recycling apparatus and, more particularly, to recycling apparatus which receives and crushes cans for recycling and dispenses coupons.

2. Description of the Prior Art

U.S. Pat. No. 4,989,507 (Rhoades et al) discloses can crushing apparatus for collecting and crushing cans. The apparatus includes a conveyor belt onto which cans are dropped. The conveyor belt includes magnetic elements for holding onto ferrous cans. Two vacuum conduits are disposed above the conveyor. The first conduit receives aluminum cans, and the second conduit receives the ferrous cans. The ferrous cans are released from the conveyor to the conduit beyond a location in which the magnetic elements terminate. Both aluminum cans and ferrous cans are conveyed upwardly to the top of the apparatus where they are crushed. Refuse which may inadvertently be associated with the cans is separated from the cans and is discharged out of the apparatus.

U.S. Pat. No. 5,239,920 (Schuff & Burnett) discloses can crusher apparatus utilizing a housing and a can receiving slot in a lower portion of the housing. Aluminum cans fall onto a conveyor belt which transmits or transports the cans to a conduit which conveys the cans to a crusher. Ferrous cans remain in the conveyor, held by magnetic elements and move off the conveyor and are discarded. After being crushed, the aluminum cans are transported upwardly by air pressure or a moving air stream to the upper portion of the housing where they remain until they are transported out of the apparatus. The cans are moved out of the apparatus by air pressure which is the exhaust portion of the air pressure applied to the conduit which transports the cans from the conveyor to the crusher.

The apparatus of the present invention simplifies the crushing of aluminum cans for recycling and dispenses both money and coupons.

SUMMARY OF THE INVENTION

The invention described and claimed herein comprises apparatus for receiving cans, for crushing the cans, and for storing the crushed cans for recycling and for dispensing coupons. Only aluminum cans are crushed for recycling. Ferrous cans are discarded. The aluminum cans are crushed in a lower portion of the apparatus, and the crushed cans are transmitted upwardly and rearwardly to a storage bin. All of the active elements for both the crushing of the aluminum cans and for dispensing coupons are disposed on a door of a housing. The door is pivoted open to allow removal and replacement of the bin containing the crushed cans and any necessary maintenance and replacement work.

Among the objects of the present invention are the following:

To provide new and useful can recycling apparatus;

To provide new and useful can crusher apparatus for recycling aluminum cans;

To provide new and useful can crusher apparatus which rejects ferrous cans and accepts only aluminum cans;

To provide new and useful can crusher apparatus in which crushed cans are stored in a removable bin;

To provide new and useful apparatus for dispensing coupons;

To provide new and useful can crusher apparatus having a housing and a door on the housing; and To provide new and useful can crusher apparatus having its active components secured to the door on the housing.

DESCRIPTION OF THE PREFERRED EMBODIMENT

Figure 1:
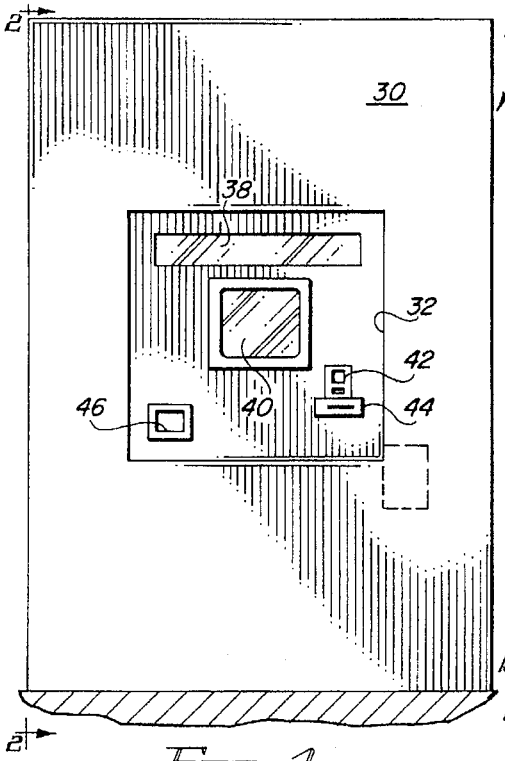
FIG. 1 is a front view of the apparatus of the present invention.
Figure 1A:
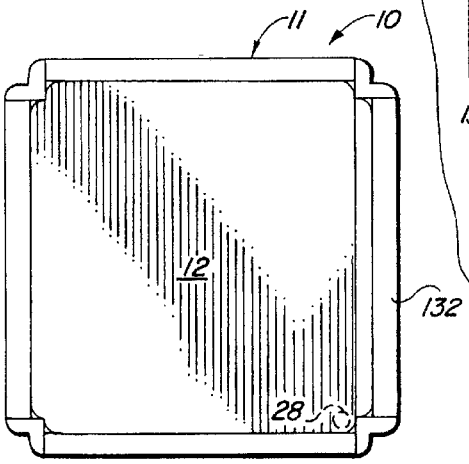
FIG. 1A is a top view of the apparatus of the present invention.

FIG. 1 is a front view of aluminum can recycling apparatus 10 of the present invention. FIG. 1A is a top view of the apparatus 10. The can recycling apparatus 10 comprises a generally rectangular housing with offset corner. The housing includes a front wall 30 which comprises a pivoting door.

Figure 2:
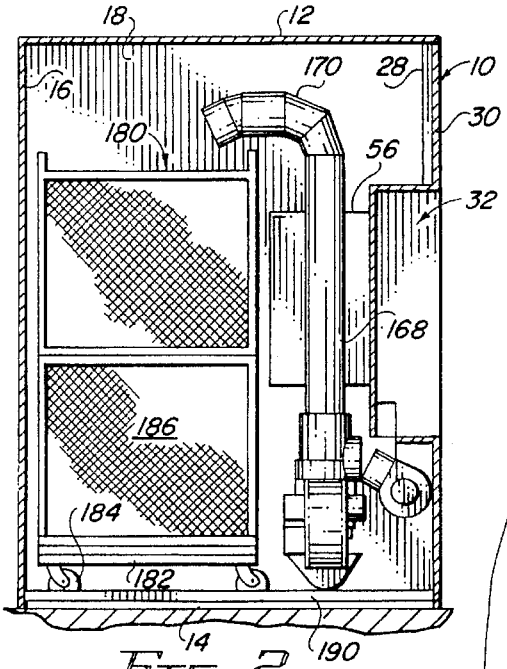
FIG. 2 is a side view, in partial section, illustrating the interior of the apparatus of the present invention, taken generally along line 2—2 of FIG. 2.

FIG. 2 comprises a view in partial section of the can crusher apparatus 10 taken generally along line 2—2 of FIG. 1, showing the door 30 secured to the housing which includes a top wall 12, a bottom or floor 14, a rear wall 16, and a pair of side walls, of which a side wall 18 is shown in FIG. 2.

Figure 3:
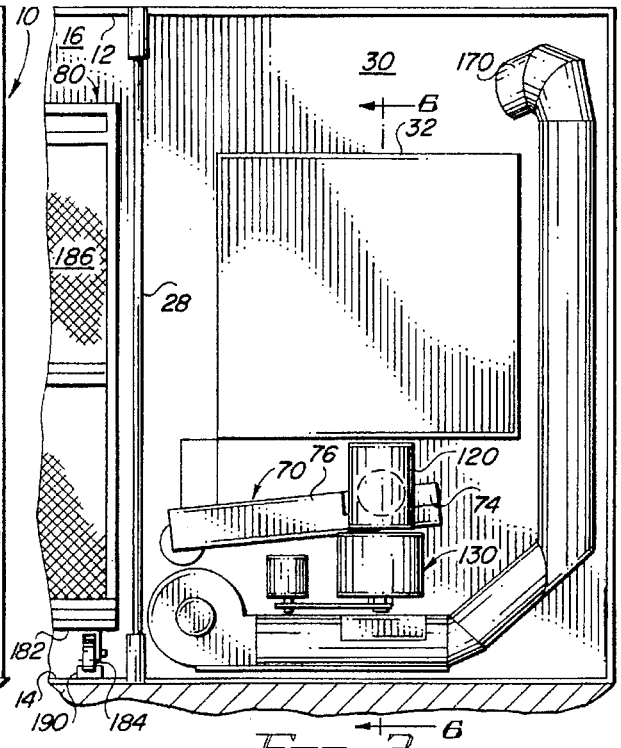
FIG. 3 is a view of a portion of the apparatus of the present invention illustrating the active component secured to a pivoting door.

FIG. 3 is a front view of the apparatus 10 showing the door 30 pivoted open on a hinge pin 28. The pin 28 pivots on the top 12 and the bottom 14.

The active elements, those involved with the crushing or recycling of aluminum cans, and those associated with dispensing coupons, are secured to the door 30. Thus, when the door 30 is pivoted open, to the position shown in FIG. 3, all of the active elements, are readily available for servicing, as required.

Figure 4:
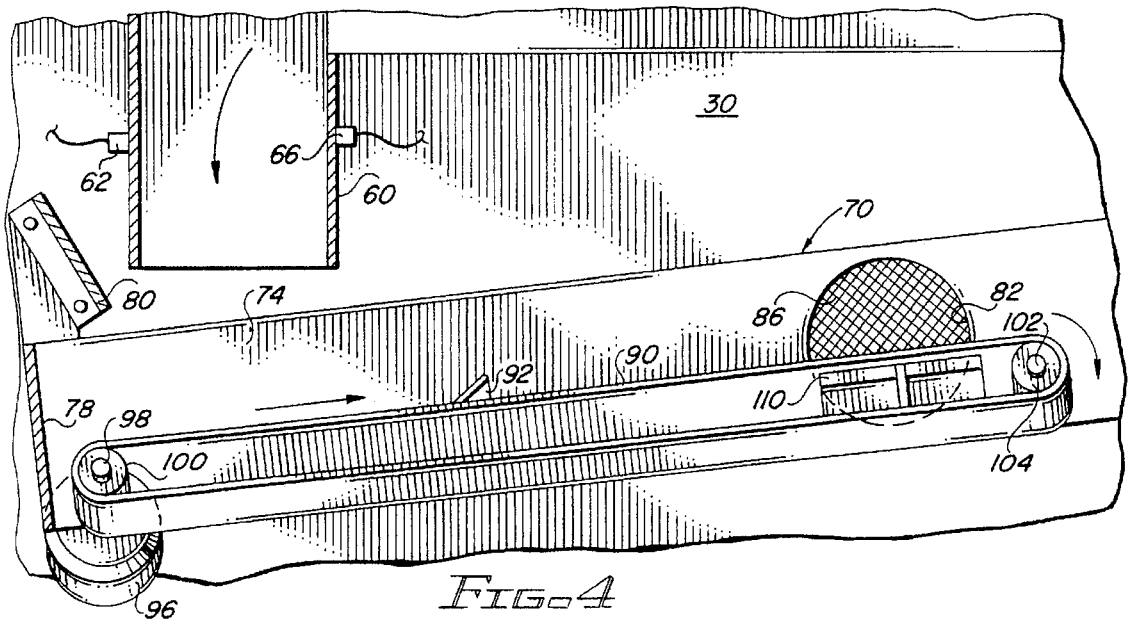
FIG. 4 is an enlarged view of a portion of the apparatus of the present invention.

The various elements involved in the recycling are shown in detail in FIGS. 3, 4, 6, and 7. FIG. 4 comprises a view of the portion of the door 30 which includes a conveyor system 70.

Figure 5:
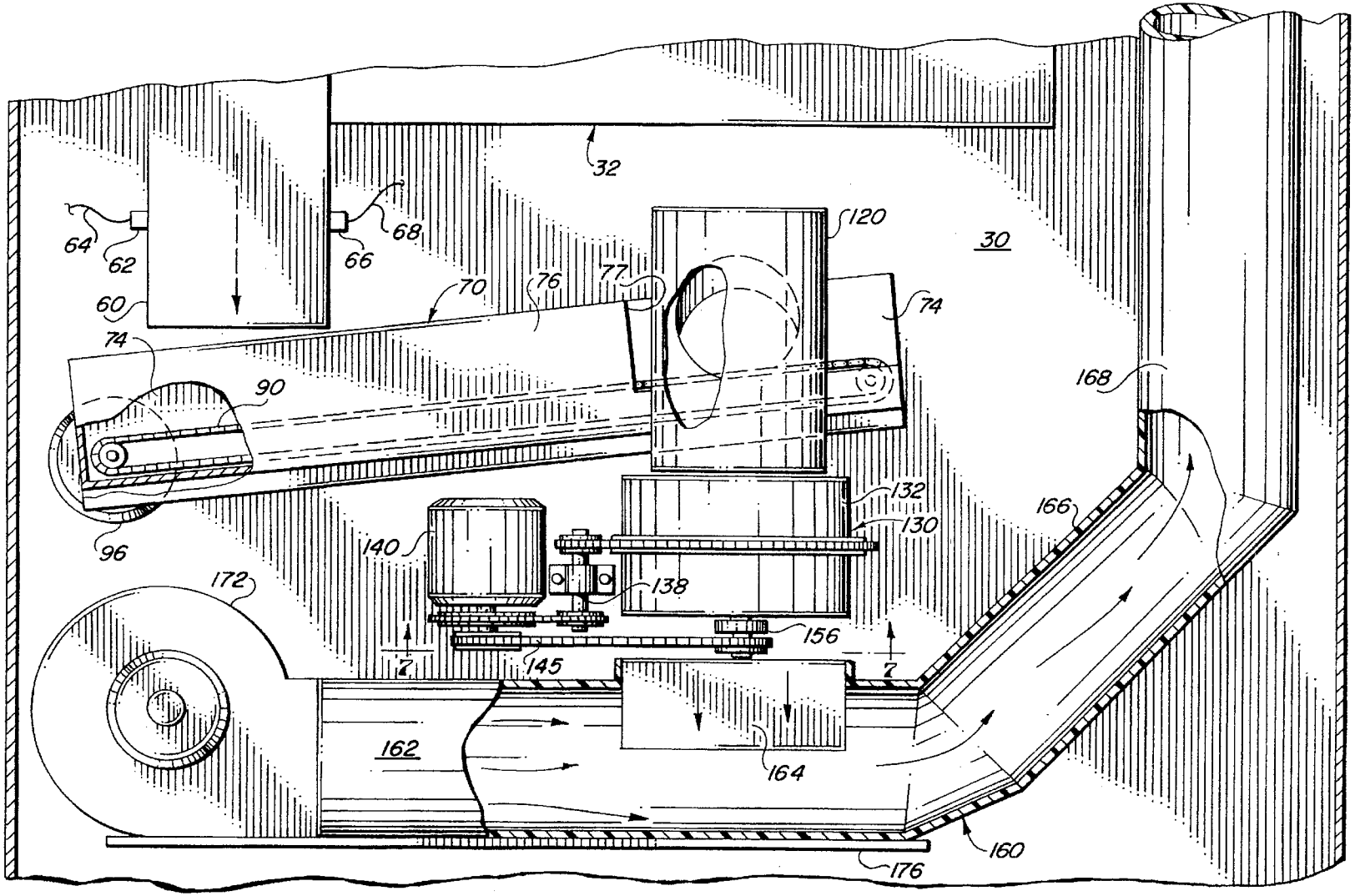
FIG. 5 is an enlarged view of a portion of the apparatus shown in FIG. 3.

FIG. 5 comprises a view in partial section of the can crushing elements, including illustrating the path taken by a can through the apparatus.

Figure 6:
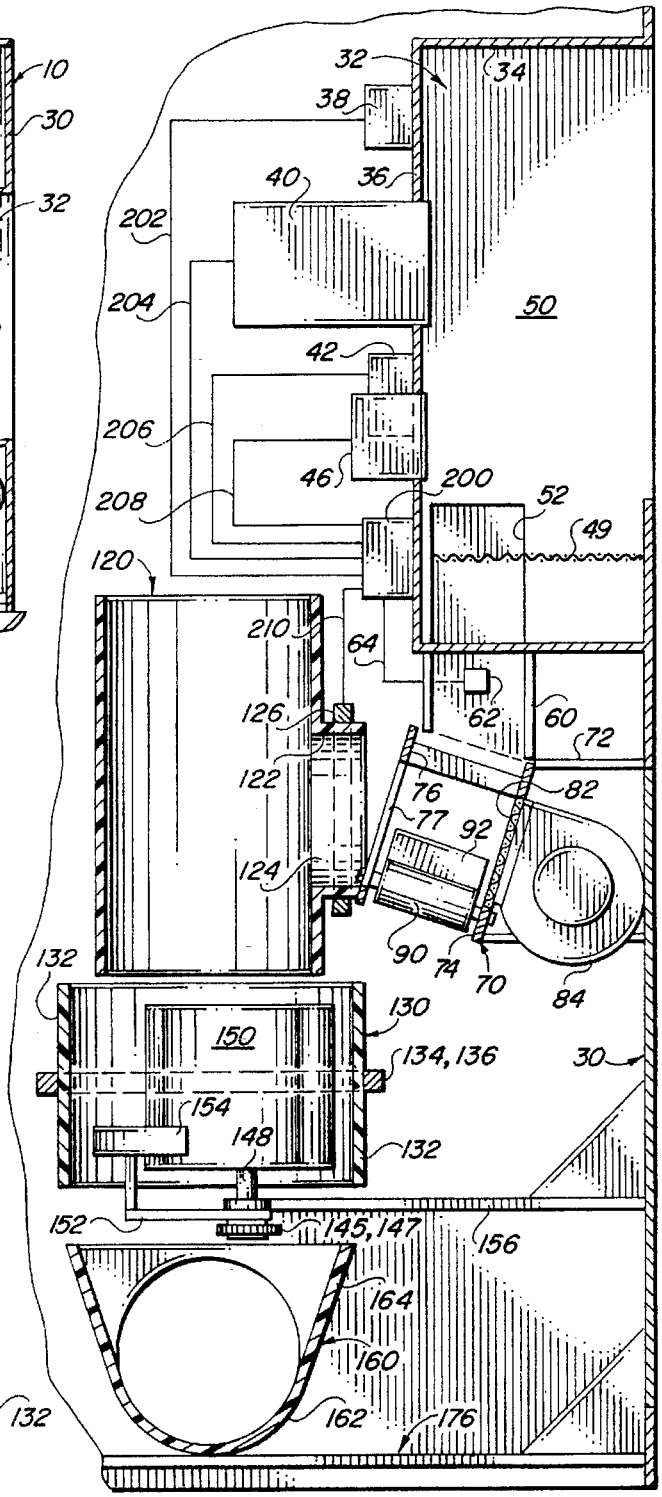
FIG. 6 is an enlarged view in partial section taken generally along line 6—6 of FIG. 3.

FIG. 6 comprises a view in partial section taken generally along line 6—6 of FIG. 3, and complementing the illustration of FIG. 5 with respect to the can crushing apparatus.

Figure 7:
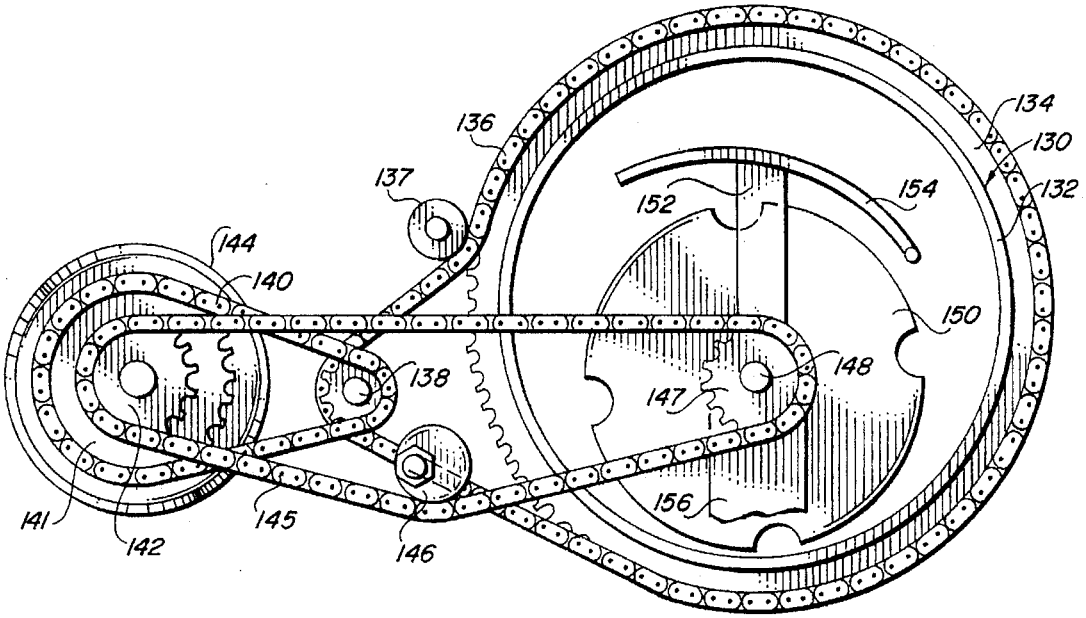
FIG. 7 is a bottom view of a portion of the apparatus of the present invention, taken generally along line 7—7 of FIG. 5.

FIG. 7 comprises a view taken generally along line 7—7 of FIG. 5, and comprises a bottom view looking upwardly through a crusher cylinder 130 and showing components associated therewith. FIG. 7 complements the illustrations of FIGS. 5 and 6.

For the following discussion, reference will generally be made to FIGS. 1–7.

As indicated above, the apparatus 10 comprises a generally rectangular or square housing with offset corners which includes the walls, as discussed above, and the front door 30 which is hingedly secured to the top 12 and bottom 14 at the side wall 18. On the exterior, or front, of the door 30 is a recess 32. The recess 32 includes a top wall 34, a back wall 36, a bottom 48, a screen 49 above the bottom 48, and a pair of side walls, of which a side wall 50 is best shown in FIG. 6. Secured to the back wall 36 of the recess 32 are such elements as a message display unit 38, a monitor 40, a coupon key pad 42, with a coupon dispenser 44 disposed at the bottom thereof, (see FIG. 1) and a coin dispenser 46.

In the side wall 36 at the screen 49 is an opening 52 for cans. The opening 52 receives the cans which are to be crushed and recycled. The opening 52 extends upwardly from the screen 49, and is best shown in FIG. 6.

A chute 60 is appropriately connected about the opening 52 and extends downwardly. The cans to be crushed fall through the chute 60 and onto a conveyor assembly 70.

Disposed on opposite walls of the chute 60 are photo cell elements 62 and 64. A can interrupts a beam between the elements 62 and 64 to activate the apparatus. The apparatus will run for a predetermined time period after the light beam is interrupted. This will be discussed in more detail below. With respect to the crushing or recycling, four motors are turned on when the apparatus is activated by the interruption of the light beam.

The conveyor assembly 70 is best shown in FIGS. 4, 5, and 6. The conveyor assembly 70 is secured to the front door 30 by appropriate support structure 72, best shown in FIG. 6. The conveyor assembly 70 includes a pair of generally parallel plates 74 and 76 spaced apart from each other. The plates 74 and 76 are joined by an end plate 78. A deflector plate 80, best shown in FIG. 4, is disposed above the plate 74 and 76 and appropriately secured thereto. The deflector plate 80 is disposed adjacent to the chute 60 to insure that cans falling through the chute 60 fall onto a belt 90 between the plate 74 and 76. The belt 90 comprises an endless belt onto which the cans fall from the chute 60 for appropriate conveyance.

An opening 82, remote from the end plate 78, extends through the plate 74. Secured to the plate 74 behind the opening 82 is a blower 84. The opening 82 is closed by a screen 86. The blower 84 blows aluminum cans to be crushed off the moving endless conveyor belt 90, as will be discussed below. The motor for the blower 84 is one of the motors activated by a falling can.

The conveyor belt 90 includes a flap 92 which extends upwardly from the belt 90. The purpose of the flap 92 is to move steel cans off the belt. The steel cans are then discarded. This will be discussed in detail below.

Extending between the plates 74 and 76 are a pair of shafts, including a shaft 98 and a shaft 102. A roller element 100 is secured to the shaft 98, and a roller element 104 is secured to the shaft 102.

Also secured to the plate 74 is a motor 96. The shaft 98 comprises a shaft for the motor 96. Thus, it is the motor 96 which drives the belt 90. The motor 96 is another of the motors activated by a falling can.

Disposed adjacent to the opening 82 and immediately below the belt 90 are magnetic elements 110. The magnetic elements 110 are strong enough to hold steel cans onto the belt 90 while the lighter, nonmagnetic, aluminum cans are blown off the belt 90 by the blower 84.

However, when the flap 92, contacts the steel cans, the flap 92 will cause the steel cans to move to the outer end of the belt 90, remote from the motor 96, and to fall off, as indicated by the large curved arrow in FIG. 4. The steel cans will thus be discarded.

The aluminum cans, on the other hand, will be blown by the blower 84 into a receiving and guide conduit 120. The conduit 120 comprises a receiver cylinder which is disposed above a crusher assembly 130. The receiver cylinder or conduit 120 includes an aperture 122 disposed oppositely the blower 84. It will be noted that the plate 76 includes an cutout 77 therein adjacent to the aperture 122 through which the aluminum cans are blown into the cylinder or conduit 120.

A guide tube 124, which is a relatively short cylindrical element, is secured to the conduit or cylinder 120 at the aperture 122. The guide tube 124 helps to make certain that the cans blown off the conveyor belt 90 fall into the conduit or cylinder 120. The cans then fall downwardly into the crusher assembly 130. This is best shown in FIG. 6.

The crusher assembly 130 includes a crusher cylinder 132 which has a larger diameter than the cylinder or conduit 120. Within the crusher cylinder 132 is a relatively large rotor 150. The rotor 150 is best shown in FIGS. 6 and 7. As indicated above, FIG. 7 comprises a bottom view, looking upwardly, taken generally along lines 7—7 of FIG. 5, and illustrates the crusher assembly and its various components. The rotor 150 crushes the cans through a steadily decreasing radius with respect to the center of rotation of the rotor 134 and the crusher cylinder 132. That is, as clearly shown in FIG. 7, the rotor 150 is asymmetrically disposed within the crusher cylinder 132.

Both the cylinder 132 and the crusher rotor 150 rotate. The dual rotation may best be understood with reference to FIG. 7. A sprocket 134 is disposed about the periphery of the cylinder 132. A drive chain 136 extends on the sprocket and is coupled to a shaft 138. A tension sprocket 137 is disposed between the sprocket 134 and the shaft 138.

The shaft 138, as best shown in FIG. 5, includes two sprockets, one for the chain 136 and one for a chain 140. The chain 140 extends to a sprocket 141 which is secured to the output shaft of a motor 144. The motor 144 is the third motor actuated by the control system in response to the broken light beam referred to above. The shaft 138 is appropriately supported and journaled for rotation.

A sprocket 142 is also secured to the output shaft of the motor 140. A drive chain 145 extends about the sprocket 142 and extends about a sprocket 147. The sprocket 147 is secured to a shaft 148. The shaft 148 is secured to the rotor 150. A tension sprocket is disposed between the sprockets 142 and 147.

Thus, activation of the motor 144 causes rotation of both the cylinder 132 and the crusher rotor 150 within the cylinder 132.

Within the cylinder 132, and disposed at the area of maximum radius between the rotor 150 and the cylinder 132, is an arm 152. At the outer end of the arm 152 is an arcuately extending deflector plate 154. The arm 152 is disposed about the shaft 148, but the shaft 148 rotates within the arm 152 such that the arm 152 and its deflector plate 154 remain fixed in place. The purpose of the deflector plate 154 is to prevent cans from falling directly through the cylinder 132, thus insuring that the cans to be crushed are crushed by the rotor 150 as it rotates within the cylinder 132.

The crusher assembly 130 is appropriately secured to the door 30 by support structure 150.

Beneath the crusher assembly 130 is a discharge conduit assembly 160, best shown in FIGS. 5 and 6. The discharge conduit assembly 160 includes a horizontal conduit portion 162, an upwardly extending conduit portion 166, and a vertical conduit portion 168. At the top or upper portion of the vertical conduit 168 is rearwardly extending nozzle portion 170. The nozzle portion is best shown in FIG. 2. Crushed cans fall into a bin 180 from the nozzle portion 170.

There is a bin portion 164 in the horizontal conduit 162 beneath the crusher cylinder 132. Crushed cans falling from the cylinder 132 fall into the bin 164, and thence into the horizontal conduit 162. The bin portion 164 is essentially a collection element to make certain that the crushed cans fall into the conduit 162.

A blower assembly 172 is connected to the horizontal conduit 162 remote from the vertical conduit 168. The blower assembly 172 includes a motor which is the fourth motor actuated in response to the broken light beam referred to above. The blower assembly 172 provides a stream of air into the conduit 162 to blow the crushed cans upwardly from the horizontal conduit 162, into the angular conduit 166 and thence upwardly into the vertical conduit 168 and out the nozzle 170 into the bin 180. The bin 180 is best shown in FIGS. 2 and 3.

The bin 180 includes a bottom 182 to which are secured four wheels 184. Extending upwardly from the bottom 182, and appropriately secured thereto and to each other, are four sides 186. The sides 186 are preferably screen, or the like.

Secured to the housing bottom 14 are two tracks 190. The wheels 184 of the bin 180 move in the tracks 190.

When the bin 180 is full of crushed cans, the door 30 is opened and the bin 190 is moved outwardly from the apparatus 10 and the filled bin is then hauled away. A replacement bin 180 is then moved into the apparatus 10 for appropriate filling with crushed cans.

The movement of the cans with respect to the conveyor assembly 70 is schematically illustrated sequentially in FIGS. 8A, 8B, 8C, 8D, 8E, and 8F. A plurality of aluminum cans 2, which are to be crushed, and recycled, and a steel can 4, which is not to be crushed, are illustrated with respect to the belt 90, the blower 84, the magnetic element 110, and the flap 92 on the belt 90, are shown in the sequential figures.

Figure 8A:
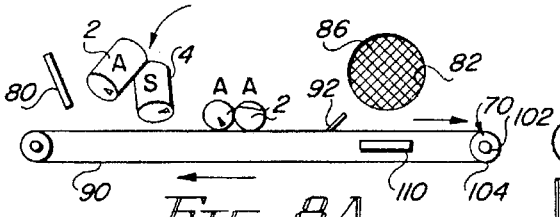
FIGS. 8A–8F schematically illustrate sequentially the path of cans along the conveyor shown in FIGS. 4, 5, and 6.

In FIG. 8A, the cans 2 and 4 are shown with respect to the belt 90 in essentially a side view. Two aluminum cans 2 are shown on the belt 92 and a can 2 and a steel can 4 are shown falling onto the belt 92.

FIGS. 8B–8F are top views of the belt 90 and the associated elements.

Figure 8B:
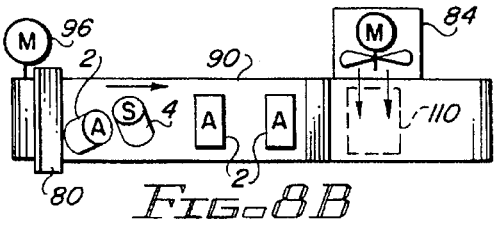
Figure 8C:
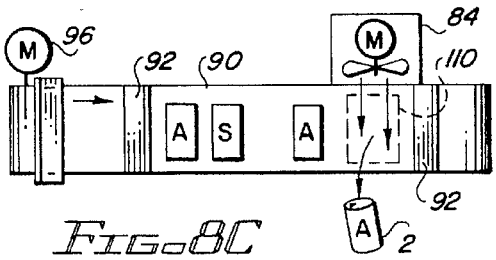
Figure 8D:
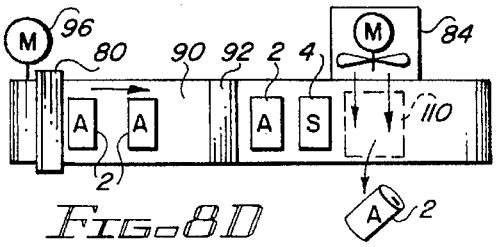

In FIG. 8B, the cans 2 and 4 are shown with respect to the belt 90 as the belt 90 moves in the direction shown by the large arrow. In FIG. 8C, the first aluminum can 2 is shown blown off the belt 90 by the blower 84. In FIG. 8D, the second can 2 is shown blown off the belt 90, and the steel can 4 is shown approaching the magnetic element 110.

Figure 8E:
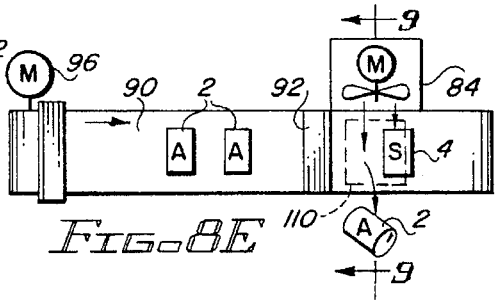

In FIG. 8E, the steel can 4 is shown held in place with respect to the belt 90 by the magnetic element 110, while the third aluminum can 2 is shown blown off the belt 90.

Figure 8F:
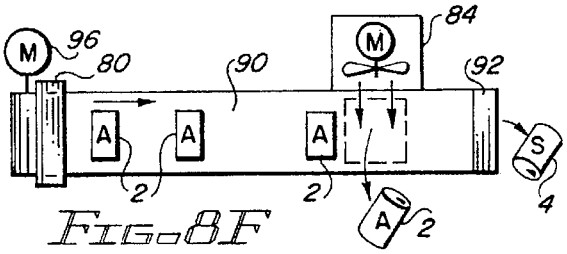

In FIG. 8C, 8D, and 8E, the sequential movement of the belt 90, with particular reference to the flap 92, is illustrated. In FIG. 8E, the flap 92 is approaching the magnetic element 10 and the steel can 4. In FIG. 8F, the flap 92 is shown moving the steel can 4 along the belt. When the conveyor belt 90 reaches its roller 104 on its shaft 102, the flap 92 simply pushes the steel can 4 off the belt 90, and the steel can 4 then falls downwardly into a trash can, or the like, not shown, for appropriate disposal.

In the meantime, another aluminum can 2 is shown in FIG. 8F being blown off the conveyor belt 90, and additional aluminum cans 2 are shown approaching the blower 84.

Figure 9:
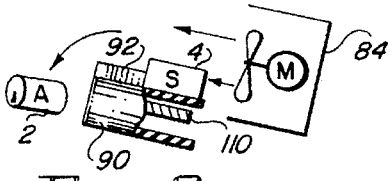
FIG. 9 is a view in partial section taken generally along line 9—9 of FIG. 8E.

FIG. 9 comprises a view in partial section taken generally along line 9—9 of FIG. 8E, and the relationship of the steel can 4, an aluminum can 2, the belt 90, the flap 92, and the blower 84 is illustrated. The can 2 is shown blown off the belt 90, while the steel can 4 remains on the belt 90 held in place by the magnetic element 110. The flap 92 is approaching the steel can 4, and subsequently, as discussed above, causes the can 4 to move on the belt 90 and then off the belt 90, to be disposed of. This is as shown in FIG. 8F and as discussed above.

Referring now particularly to FIGS. 1 and 6, a control box 200 is shown secured to the back wall 36 of the recess 32. The control box 200 is connected to the various elements of the apparatus, such as the message display 38, the monitor 40, the coupon keypad 42, with its dispenser 44, and the coin dispenser 46, by appropriate conductors 202, 204, 206, and 208, respectively. The control box 200, or specifically the control elements therein, which include a microprocessor and appropriate read only memory elements, also controls the four rotors specifically referred to above, including the motor of the blower 84, the conveyor motor 96, the crusher motor 144, and the motor associated with the blower 172. Microprocessor control is old and well known in the art, and thus is not discussed in detail herein. Moreover, for purposes of simplicity, the electrical connections between the control box 200 and the various motors is not illustrated. Again, such elements and connections are well known and understood in the art.

The control circuitry is actuated by a can breaking the light beam between the elements 62 and 66 (see FIG. 5). The light elements or photo elements 62 and 66 are connected to the control circuitry within the control box 200 by conductors 64 and 68, respectively. See FIG. 5 as well as FIG. 6.

Aluminum cans to be crushed and recycled are inductively counted by an inductive coil 126 disposed about the guide tube 124. A conductor 210 extends from the coil 126 to the control circuitry within the control box 200. Again, the operation of the sensing coil and its associated elements is well known and understood in the art.

Coins are disposed by the coin dispenser 46 in response to the sensing of the aluminum cans by the coil 126.

As indicated above, the control circuitry is activated when the light beam between the elements 62 and 66 is interrupted by a can falling through the chute 60. In addition to actuating the four motors discussed in detail above, the control circuitry also actuates the monitor 40, which may play a video advertising one or more products etc. The message display 38 is also actuated to provide a moving message or a plurality of sequential moving messages, which may include instructions for operating the coupon dispenser keypad 42, or any desired message or messages.

Different products or services being advertised on the message display 38 and the monitor 40 will be numbered or otherwise identified by simply keying or entering a desired number or term or whatever into the keypad 42, a coupon relating to the desired product or services is then dispensed by the coupon dispenser 44.

While a user is inserting cans to be crushed and recycled, information is being provided regarding goods and services. Coupons relative to the goods and services are then dispensed in response to input by the user through the keypad 42.

Thus, a user of the apparatus 10 receives coins for recycling aluminum cans, and receives coupons in response to a positive reaction to advertising, the reaction being the entering of specific information into the keypad.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What we claim is:

1. Aluminum can recycling apparatus, comprising, in combination:

a housing;

a door pivotally secured to the housing;

conveyor means secured to the door for transporting cans;

first blower means secured to the door for blowing cans to be crushed off the conveyor;

crusher means secured to the door for receiving and crushing the cans blown off the conveyor;

a storage bin within the housing for storing the crushed cans; and means for controlling the conveyor means, the first blower means, and the crusher means in response to the introduction of a can to be crushed.

2. The apparatus of claim 1 which further includes a receiver cylinder secured to the door and disposed above the crusher for receiving a can to be crushed from the conveyor means and through which the can falls to the crusher means.

3. The apparatus of claim 2 which further includes a conduit secured to the door and disposed below the crusher and extending to the storage bin through which the crushed can moves.

4. The apparatus of claim 3 which further includes second blower means for blowing the crushed cans in the conduit.

5. The apparatus of claim 1 in which the storage bin comprises a wheeled bin movable into and out of the housing.

6. The apparatus of claim 5 which further includes second blower means in the second conduit for blowing the crushed cans to the storage bin.

7. The apparatus of claim 1 in which the conveyor means includes an endless belt on which the cans drop for moving the cans, magnetic means disposed adjacent to the endless belt and adjacent to the receiver cylinder for holding steel cans onto the belt to prevent the steel cans from being blown from the endless belt into the receiver cylinder, a tab on the endless belt for moving the steel cans away from the magnetic means and off the endless belt to be discarded, and a motor for moving the endless belt.

8. The apparatus of claim 7 which further includes a plate adjacent to the endless belt to prevent the cans from falling off the endless belt.

9. The apparatus of claim 8 in which the plate is disposed at an acute angle to the door.

10. The apparatus of claim 9 in which the endless belt includes a top portion on which the cans move, and the top portion defines a plane which is generally perpendicular to the plate.

11. The apparatus of claim 1 which further includes a chute secured to the door for receiving cans to be crushed;

means for sensing cans to be crushed;

means for holding steel cans on the endless belt; and coin dispenser means secured to the door for dispensing coins in response to the cans to be crushed.

12. The apparatus of claim 1 which further includes display means for displaying advertising information.

13. The apparatus of claim 12 which further incudes keypad means for providing input in response to the advertising information.

14. The apparatus of claim 13 which further includes a coupon dispenser means for dispensing coupons in response to the input on the keypad means.

15. The apparatus of claim 1 which further includes a monitor secured to the door for providing desired information.

16. The apparatus of claim 1 which further includes a message display for providing desired messages.

17. The apparatus of claim 1 in which the housing includes a floor and the bin for receiving and storing crushed cans is movable on the floor.

18. The apparatus of claim 17 which further includes tracks on the floor for guiding the storage bin as the storage bin moves on the floor.

19. Aluminum can recycling and coupon dispenser apparatus comprising in combination:

a housing;

a door pivotally secured to the housing;

an opening in the door through which cans are fed for recycling;

conveyor means secured to the door for receiving the cans for recycling;

crusher means secured to the door for receiving cans from the conveyor means and for crushing the cans for recycling; and control means for actuating the conveyor means and the crusher means in response to a can moving from the opening to the conveyor means.

20. The apparatus of claim 19 which further includes a chute disposed at the opening and through which the can falls to the conveyor means.

21. The apparatus of claim 20 which further includes means for sensing a can falling through the chute and connected to the control means for actuating the conveyor means and the crusher means.

22. The apparatus of claim 21 in which the crusher means includes a rotating crusher cylinder and a rotor disposed within the crusher cylinder.

23. The apparatus of claim 22 in which the crusher means further includes a motor for rotating the crusher cylinder and the rotor for crushing cans.

24. The apparatus of claim 19 which further includes display means for displaying advertising.

25. The apparatus of claim 24 which further includes coupon dispensing means for dispensing coupons related to the displayed advertising.

26. The apparatus of claim 25 in which the coupon dispensing means includes a keypad for entering information in response to the displayed advertising and a coupon dispenser for dispensing coupons in response to the information entered into the keypad.

* * * * *